US005613445A

United States Patent [19]

Rismiller

[11] Patent Number: 5,613,445

[45] Date of Patent: Mar. 25, 1997

[54] LOCOMOTIVE

[75] Inventor: Dennis E. Rismiller, Shelby, Ohio

[73] Assignee: Plymouth Locomotive International, Inc., Plymouth, Ohio

[21] Appl. No.: 467,186

[22] Filed: Jun. 6, 1995

[51] Int. Cl.[6] ..... B61F 5/26

[52] U.S. Cl. ..... 105/224.1; 105/453; 105/218.2

[58] Field of Search ..... 105/453, 165, 105/199.1, 218.2, 224.1, 179; 280/716, 717, 681, 687, 688, 690; 267/3, 4

[56] References Cited

U.S. PATENT DOCUMENTS

| | | | |
|---|---|---|---|
| 4,166,611 | 9/1979 | Geers | 105/218.1 |
| 4,323,710 | 6/1994 | Manstrom | 105/30 |
| 4,421,339 | 12/1983 | Hagin | 105/3 |
| 4,527,487 | 7/1985 | Pinto | 105/224.1 |
| 4,787,318 | 11/1988 | Vogel | 105/136 |

*Primary Examiner*—Robert J. Oberleitner
*Assistant Examiner*—C. T. Bartz
*Attorney, Agent, or Firm*—Renner, Otto, Boisselle, Sklar

[57] ABSTRACT

An industrial railroad locomotive includes a chassis with wheel sets supporting the locomotive for movement along the rails. A suspension system for each respective wheel set includes torque bars extending transversely of said chassis. Links secured to the ends of the torque bars and pivotally connected to brackets on each side of the respective wheel set are operative to urge the wheel set downwardly with respect to the locomotive chassis to maintain each wheel of the set in contact with the respective rail while permitting side-to-side canting of the wheel set with respect to the chassis in a generally vertical plane. Spring snubbers at each side of a wheel set are positioned between the wheel set brackets and chassis frame supporting the weight of the locomotive on the respective wheel set, while permitting such side-to-side canting. The spring snubbers include a ball and socket interface between the wheel set and springs mounted on the chassis frame.

21 Claims, 3 Drawing Sheets

LOCOMOTIVE

Disclosure

This invention relates generally as indicated to a locomotive, and more particularly to a suspension system for an industrial locomotive.

BACKGROUND OF THE INVENTION

Industrial locomotives are usually much smaller than road locomotives widely used on Class I or shortline railroads. Such industrial locomotives are used for switching or shunting cars at industrial sites. They are also widely used to haul bulk materials in quarries, mines or even tunnels under construction. The track for such locomotives may be narrow gauge, and in many instances temporary. All too frequently the track is substandard and has considerably less than an ideal geometry. Moreover, the track is often built in less than ideal space and environmental conditions. Derailments are frequent and rerailments difficult. Some of the track may even be made of wooden rails.

The suspension of the locomotive wheel sets for very rough trackage creates special problems, particularly if the required wheel adhesion or tractive or braking effort is to be maintained. The problem is particularly acute in a direct drive locomotive where the wheel set may include a housing, differential, and a drive shaft connected to the differential. It is important that both wheels of the set engage the rail with enough force to prevent wheel slip, and also be afforded a relatively wide range of canting movement or rocking in a vertical plane such as might be caused when one rail is lower than the other, or such rails are out of transverse gauge or alignment. In a direct drive locomotive, it is desirable that the canting of the wheel set be as nearly as possible about the drive shaft connection or the lateral center of the wheel set. This is particularly important in a direct drive locomotive where both the driving and braking forces are transmitted from the locomotive chassis.

Since the weight of half of the locomotive may be carried by a wheel set, the spring system between the wheel set and the frame should permit such extreme canting and be positioned in each side of the wheel set so that only the spring system on one side may support substantially the entire weight of one-half of the locomotive, with the other side literally lifting off its seat between the frame and wheel set. While this accommodation of such rather wide ranging movement of the wheel set for rough trackage is important, it is also important that the spring or snubber system taking a substantial portion of the weight of the locomotive permit this motion while transferring the weight of the locomotive to the rails to maintain wheel adhesion and tractive effort for both driving and braking forces. Accordingly, the spring snubber system, in addition to being properly located, should also have the capacity and range of movement to accommodate the conditions noted above.

SUMMARY OF THE INVENTION

The industrial railroad locomotive of the present invention includes at least one wheel set at each end of the locomotive, and the suspension system for each wheel set includes two components. The first component is a torque bar suspension which may include two vertically spaced torque bars for each wheel set with generally horizontal parallel links connecting the torque bar ends to the vertical leg of an L-shape bracket attached on each side of the respective wheel set. The links are connected to the brackets with spherical bearings. The torque bar and link system takes some of the weight of the locomotive urging the wheels of the set into contact with the rails and also maintains the wheel set properly connected to the frame or chassis while permitting rather sever canting movement in a transverse horizontal plane. As substantial portion of the weight of the locomotive is absorbed by spring snubber sets positioned between the top of the L-shape brackets and the underside of the frame. The preferred spring system uses stacked bonded elastomeric sleeves although coil springs or other type springs may be employed.

The springs are inserted in a housing on the underside of the frame and urge a hardened spherical seat or socket downwardly. The seat engages a ball mounted on the bracket top above the wheel set. The interface between the ball and socket may be lubricated and the entire assembly is enclosed in a boot. The assemblies are paired on each side of and are symmetrical about the center of the wheel set. The spring snubber assemblies are effective to dampen vertical shocks limiting overall vertical movement of the wheel set with respect to the frame, and yet permit rather wide canting in a vertical plane. The suspension system is particularly suitable for a direct drive locomotive where the wheel set includes a differential and housing to which the L-shape brackets are secured and which includes a drive shaft extending generally horizontally from the frame to the center of the wheel set. The ball and socket mechanism permits the required degree of freedom for rough track while in combination with the parallelogram mechanism maintains the ability to transmit both driving and braking forces to the chassis through the torque bars. The parallelogram mechanism maintains the alignment of the ball and socket even with wide ranging movement. It is also easy to service and replace components for field repairs and servicing.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
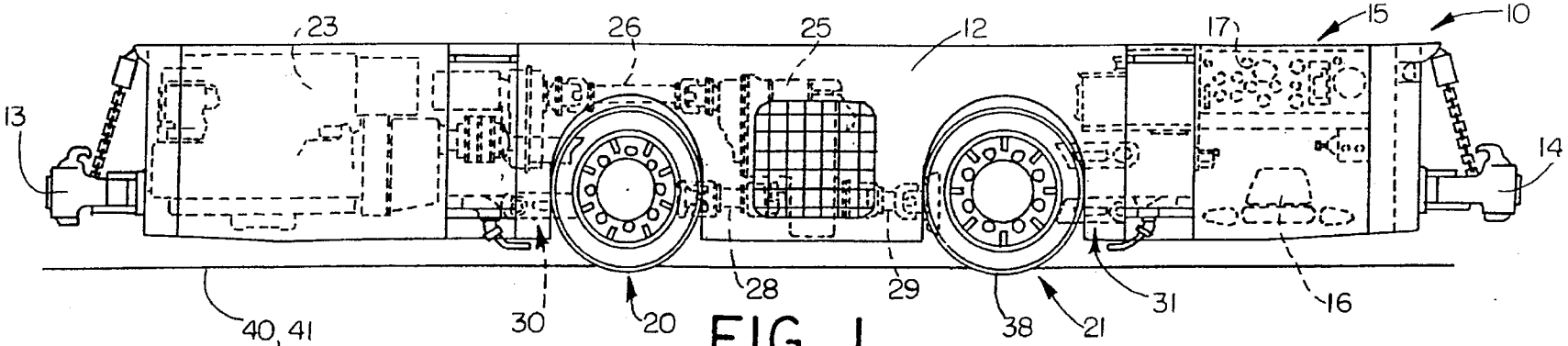
FIG. 1 is a side elevation of an industrial locomotive in accordance with the present invention.

Referring initially to FIG. 1, there is illustrated an industrial locomotive in accordance with the present invention. The locomotive is shown generally at 10, and it will be appreciated that the illustrated embodiment is in the form of a low profile mine locomotive. The locomotive includes a frame or chassis 12, couplers 13 and 14 at each end, and a driver's compartment shown generally at 15. As illustrated, the driver sits on the seat 16 facing the viewer and also his control console shown generally at 17. The locomotive is supported by two spaced wheel sets shown generally at 20 and 21. The locomotive is powered by an internal combustion engine shown generally at 23 which drives transmission 25 between the wheel sets through drive train 26 which passes over the wheel set 20. From the transmission 25, drive shafts 28 and 29 extend horizontally to the approximate centers of the wheel sets 20 and 21, respectively. The drive shafts are connected to differentials in the approximate center of each wheel set. Each wheel set is suspended by the parallelogram linkage shown generally at 30 and 31 which extends horizontally from the frame or chassis on opposite sides of the respective drive shafts. Driving forces are transmitted through the drive shafts, while hydraulic disc brakes are located inboard of each wheel as seen at 32 and 33. The wheel sets are supported by the suspension system hereinafter described in detail.

Figure 2:
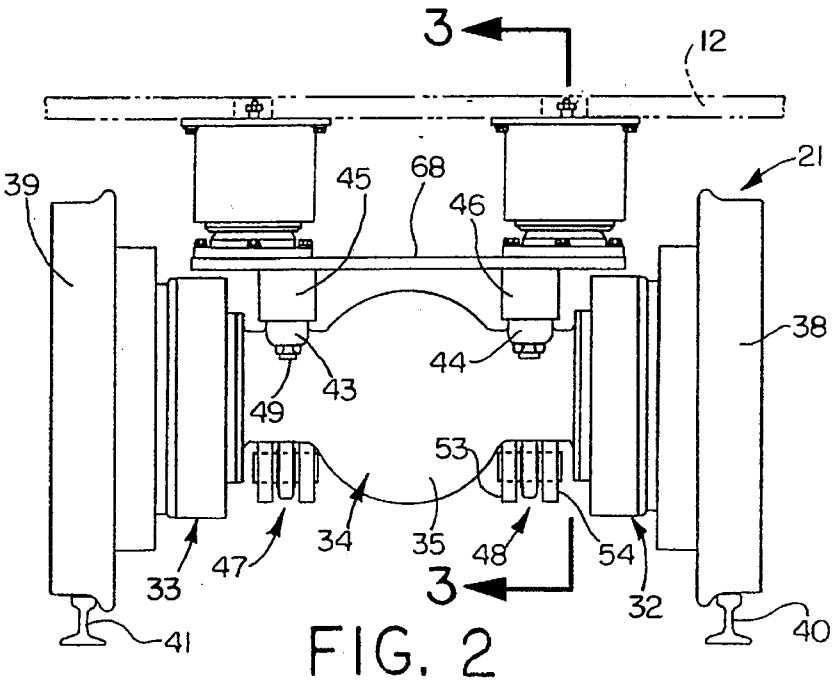
FIG. 2 is an enlarged elevation of the suspension system taken parallel to the axis of the wheel set.
Figure 3:
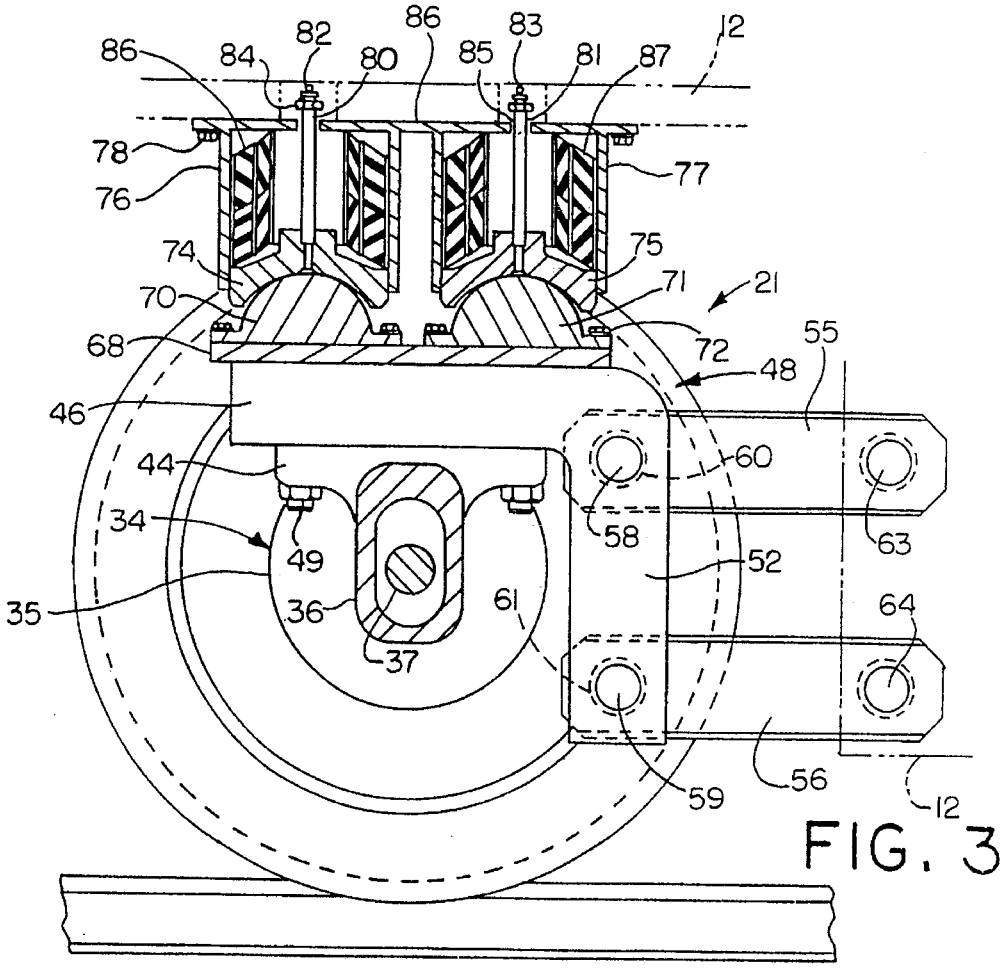
FIG. 3 is a vertical section taken substantially from the line 3—3 of FIG. 2 showing the torque bar linkage and the spring snubbers.

Referring now to FIGS. 2 and 3, it will be seen that the wheel set 21 comprises a housing 34 which is enlarged at the center as indicated at 35 to accommodate the differential but which reduces to the configuration seen more clearly at 36 in FIG. 3 housing the shaft 37 which extend from the differential to the driven wheel 38. A similar shaft extends oppositely from the differential to the driven wheel 39 and both such wheels ride on the rails 40 and 41, respectively, as seen more clearly in FIGS. 2 and 4.

Positioned fairly closely to the differential enlargement and symmetrically on each side thereof, the housing 34 includes lateral enlargements or saddles seen at 43 and 44. To the saddles are secured the upper horizontal arms 45 and 46 of L-shape brackets 47 and 48. The brackets are secured to the housing by the fasteners indicated at 49. The vertical leg of each bracket shown generally at 52 in FIG. 3 is actually two side-by-side legs as seen at 53 and 54 in FIG. 2. Pivoted between such side-by-side legs are two parallel links 55 and 56. The pivots between the links and brackets shown at 58 and 59 include spherical bearings 60 and 61 for such links. This accommodates the canting movement hereinafter described and illustrated in FIG. 4. The generally horizontal links 55 and 56 are also secured to the ends of torque bars 63 and 64 mounted in the frame 12. The torque bars urge the pivots in a counterclockwise direction as viewed in FIG. 3 urging the wheel set downwardly with respect to the frame 12 and wheels 38 and 39 into engagement with the rails 40 and 41, respectively.

Secured to the top of such L-shape brackets and bridging such brackets is a plate 68. The plate 68 on each side of the wheel set slightly outboard of the bracket has secured thereto a pair of half-balls seen at 70 and 71 in FIG. 3. The half-balls are secured to the top of the plate by the fasteners indicated at 72 and the half-ball of each pair is aligned fore and aft of the locomotive. The balls are designed to meet with and engage ball sockets 74 and 75 which move vertically in tubular housings 76 and 77 secured to the underside of frame or chassis 12 by fasteners 78. A grease pipe is threaded into the top of each ball socket as indicated at 80 and 81. Each grease pipe is provided with a grease fitting seen at 82 and 83 permitting the interface between the hardened ball and socket to be lubricated. Each grease pipe includes a nut seen at 84 which limits downward movement of the ball socket by engaging the edge of the restrictive hole 85 in the top wall 86 of the housing. Positioned above the ball sockets are bonded spring bushings shown generally at 86 and 87, and in more detail in FIG. 5.

Figure 5:
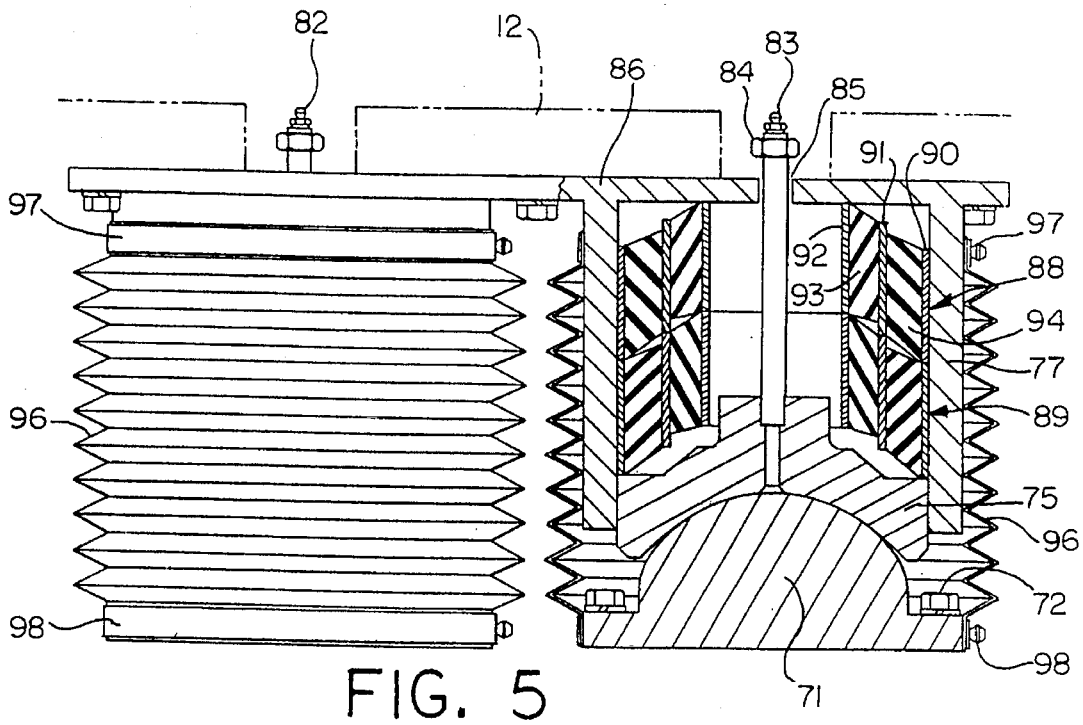
FIG. 5 is an enlarged section of the preferred spring snubber assembly.

Referring now to FIG. 5, it will be seen that there are actually two bonded spring bushings in each spring snubber assembly as shown generally at 88 and 89. Each set includes three metal sleeves seen at 90, 91 and 92 which are progressively axially offset with the inner sleeve being significantly offset from the outer sleeve. Between such sleeves are two concentric bonded rings of elastomer seen at 93 and 94 which bond the three rings together as a unit. Under axial load, the rings try to line up but this is resisted by the elastomeric material. Such units stacked as indicated make excellent spring snubbers for the illustrated suspension system.

It is noted that each individual assembly may be enclosed in a boot shown at 96 secured at top and bottom by the hose clamps 97 and 98 to the housing 77 and half-ball base plate, respectively.

Figure 6:
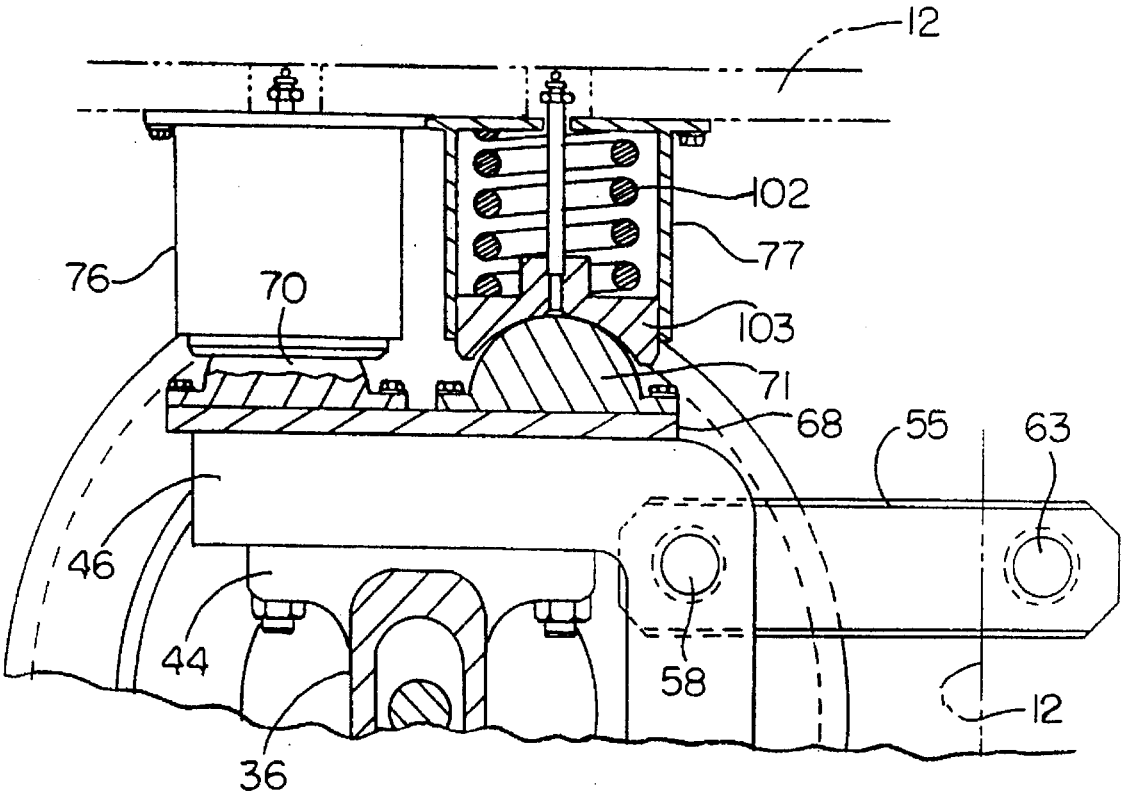
FIG. 6 is a fragmentary section like FIG. 3 of another form of spring.

In FIG. 6, there is illustrated a slightly modified spring snubber assembly utilizing in each housing 76 and 77 a heavy duty coil spring shown generally at 102. The interior of the ball socket 103 has been modified and simplified to receive the coil spring which extends from the plate 86 to the interior of the ball socket. Although the bonded spring bushing embodiment of FIGS. 3 and 5 is preferred, other forms of springs such as the illustrated coil spring of FIG. 6 may be employed.

Figure 4:
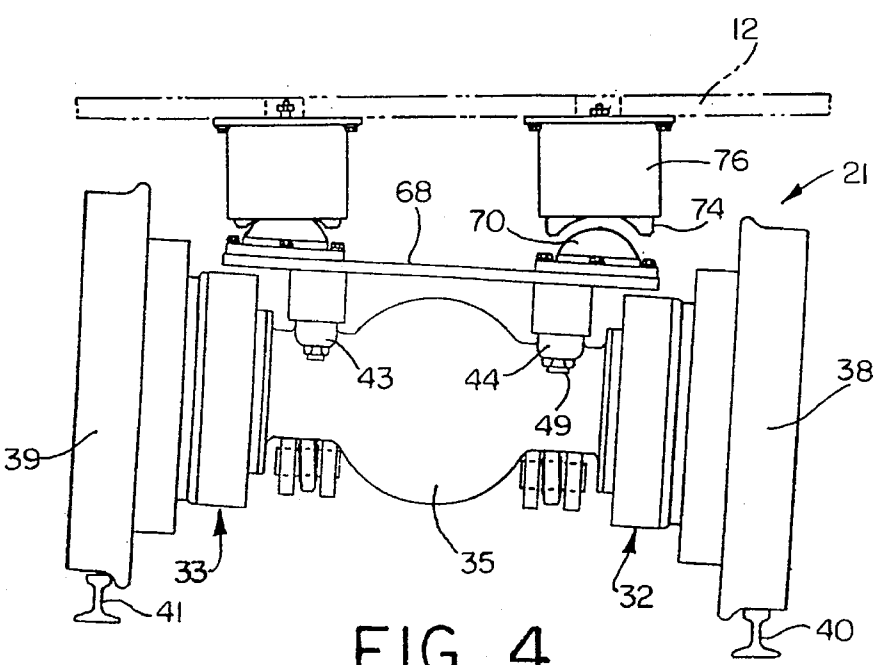
FIG. 4 is a view like FIG. 2 showing the wheel set canted.

Referring now to FIG. 4, it will be seen that the suspension system of the present invention permits a large degree of canting or angular movement of the wheel set in a vertical plane extending transversely of the rails. In FIG. 4, the spring snubber set on the right-hand side has actually moved to provide a significant separation between the ball and socket and literally all of the weight of one-half of the locomotive may be absorbed by the opposite spring snubber set. In any event, considerable rocking or canting movement is permitted with both wheels still engaging the uneven rails. This flexibility of the wheel set is primarily about the center of the differential with little movement from the center. It is noted that the spherical bearings and the spacing of the vertical components of the L-shape bracket readily permit such canting movement while maintaining the wheel set off the ground and on the rail with good adhesion. The parallel links in the system maintain and return the wheel set axle to the same relative axis of half-ball and socket.

It is also noted that the suspension system of the invention is easy to maintain and to repair, or to replace broken or worn springs. With the boot removed and sufficient clearance between the ball and socket, the socket can be removed simply by removing the nut 84. This provides access to the interior of the housing 77. If necessary, the half-balls can also quickly be removed and/or replaced.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A railroad locomotive comprising a chassis frame, wheel sets supporting said locomotive for movement along the rails, a suspension system for each respective wheel set comprising at least one torque bar means extending transversely of said frame, links secured to the ends of the torque bar means and pivotally connected to each side of the respective wheel set and operative to urge the end of the wheel set downwardly with respect to the locomotive frame to maintain each wheel of the set in contact with the respective rail while permitting side-to-side canting of the wheel set with respect to the frame in a generally vertical plane, and spring snubbers at each side of a wheel set between the wheel set and frame supporting the weight of the locomotive on the respective wheel set.

2. A locomotive as set forth in claim 1 including an L-shape bracket on each wheel set including a vertical leg, two torque bar means in said chassis frame, and parallel links connecting each torque bar means to a vertical leg of said bracket.

3. A locomotive as set forth in claim 1 wherein said links are connected to said wheel set with a spherical bearing to permit such side-to-side canting.

4. A locomotive as set forth in claim 1 including a snubber spring assembly on each side of the wheel set, and a ball and socket engagement between the assembly and wheel set.

5. A locomotive as set forth in claim 1 including paired snubber spring assemblies on each side of the frame above the wheel set, and a ball and socket contact connection between the wheel set and each spring assembly.

6. A locomotive as set forth in claim 1 wherein said wheel set is drive shaft driven at the substantial center thereof, and brackets on each side of said center, said links connecting said brackets to said torque bar means.

7. A locomotive as set forth in claim 1 including two torque bar means for each wheel set, brackets on said wheel sets, and links connecting the ends of each torque bar means and said brackets.

8. A locomotive as set forth in claim 1 including link brackets on said wheel sets, pivotally connected to said links, and said spring snubbers being positioned between said brackets and frame.

9. A locomotive as set forth in claim 8 wherein said brackets are L-shape and include a vertical and horizontal leg, said links extending horizontally between said frame and vertical leg, and said springs extending vertically between said horizontal leg and frame.

10. A locomotive comprising a main chassis frame, wheel sets spaced along said chassis frame for supporting said locomotive for movement along the rails, a suspension system for each respective wheel set comprising, at least one torque bar means extending transversly of said frame, link means extending generally horizontally between each side of a wheel set and the chassis frame to position and connect the wheel set with respect to the frame while permitting angular rocking movement of the wheel set in a generally vertical plane substantially about its center, and snubber springs at each side of the chassis frame above a wheel set supporting the weight of the locomotive on the respective wheel set.

11. A locomotive as set forth in claim 10 including an L-shape bracket secured to each side of a wheel set, each bracket including a vertical leg and horizontal arm, said snubber springs extending between said horizontal arm and chassis frame, while said link means extends between said vertical leg and chassis frame.

12. A locomotive as set forth in claim 11 including two torque bars for each wheel set, and parallel links extending between the ends of each torque bar and said vertical leg.

13. A locomotive as set forth in claim 12 including spherical bearings connecting said links to said brackets.

14. A locomotive as set forth in claim 12 including a ball and socket connection between said chassis frame and horizontal arm at said snubber springs.

15. A locomotive as set forth in claim 14 wherein the ball portion of the connection is on the bracket and the socket portion is spring loaded on said chassis frame.

16. A locomotive as set forth in claim 15 including housings for said spring snubbers on said chassis frame above the respective wheel set, said housings containing springs urging said sockets downwardly.

17. A locomotive as set forth in claim 16 wherein said springs comprise bonded metal and elastomer bushings.

18. A locomotive as set forth in claim 16 wherein said springs comprise metal coil springs.

19. A locomotive as set forth in claim 16 including means to lubricate the ball and socket connection.

20. A locomotive as set forth in claim 16 wherein said wheel set is drive shaft driven at the substantial center thereof.

21. A locomotive as set forth in claim 20 wherein said locomotive includes only two wheel sets, each driven from a transmission between said wheel sets.

* * * * *